US008240663B2

(12) United States Patent
Krämer

(10) Patent No.: US 8,240,663 B2
(45) Date of Patent: Aug. 14, 2012

(54) SECURITY CONTAINER FOR VALUE DOCUMENTS

(75) Inventor: Walter Krämer, Wiedergeltingen (DE)

(73) Assignee: Giesecke & Devrient GmbH, Munich (DE)

( * ) Notice: Subject to any disclaimer, the term of this patent is extended or adjusted under 35 U.S.C. 154(b) by 42 days.

(21) Appl. No.: 12/307,720

(22) PCT Filed: Jul. 6, 2007

(86) PCT No.: PCT/EP2007/006011

§ 371 (c)(1),
(2), (4) Date: Mar. 9, 2009

(87) PCT Pub. No.: WO2008/003512

PCT Pub. Date: Jan. 10, 2008

(65) Prior Publication Data

US 2009/0212486 A1 Aug. 27, 2009

(30) Foreign Application Priority Data

Jul. 7, 2006 (DE) ..... 10 2006 031 535

(51) Int. Cl.
*B65H 31/26* (2006.01)

(52) U.S. Cl. ..... 271/220; 271/214; 271/314

(58) Field of Classification Search ..... 271/182, 271/184, 188, 189, 220, 314, 209, 214, 215, 271/217; 902/9–13; 232/1 D
See application file for complete search history.

(56) References Cited

U.S. PATENT DOCUMENTS

| | | | | |
|---|---|---|---|---|
| 1,048,409 | A | 12/1912 | Hoskins | |
| 3,854,714 | A | 12/1974 | Hatanaka | |
| 4,679,700 | A * | 7/1987 | Tharrington et al. | 220/825 |
| 6,142,469 | A * | 11/2000 | Nanba et al. | 271/288 |
| 6,722,802 | B2 * | 4/2004 | Teo et al. | 400/718 |
| 7,029,008 | B2 * | 4/2006 | Nishida et al. | 271/223 |
| 7,722,024 | B2 * | 5/2010 | Jeong | 271/3.08 |
| 2003/0011121 | A1 * | 1/2003 | Kobayashi et al. | 271/3.14 |

(Continued)

FOREIGN PATENT DOCUMENTS

DE 270083 2/1914

(Continued)

OTHER PUBLICATIONS

International Search Report for PCT/EP2007/006011, Thibaut, Emile, EPO-Internal, Nov. 6, 2007.

*Primary Examiner* — Jeremy R Severson
(74) *Attorney, Agent, or Firm* — Bacon & Thomas, PLLC

(57) ABSTRACT

A security container for storing documents of value in stack form is provided with a stacking pocket for receiving documents of value in a stacked form, a bottom element disposed in the stacking pocket on which rests a fed document of value or a stack of fed documents of value, and an inlet opening leading into the stacking pocket which is disposed such that documents of value fed to the security container fall onto the bottom element. In the transport direction there is disposed at least one closing element with at least one portion which is deflectable from a closing position, in which it prevents a motion of a document of value back into the inlet opening, into a passing position in which it guides the document of value and in which onto the portion there acts a restoring force driving towards the closing position.

15 Claims, 6 Drawing Sheets

U.S. PATENT DOCUMENTS

| | | | | |
|---|---|---|---|---|
| 2003/0184011 | A1* | 10/2003 | Schaareman et al. | 271/207 |
| 2006/0181017 | A1* | 8/2006 | Peulen | 271/314 |
| 2009/0014946 | A1* | 1/2009 | Nagura et al. | 271/220 |

FOREIGN PATENT DOCUMENTS

| | | | |
|---|---|---|---|
| DE | 103 16 192 | A1 | 2/2005 |
| EP | 0 793 197 | A2 | 9/1997 |
| GB | 1598168 | | 9/1981 |
| JP | 61-18666 | | 1/1986 |
| JP | 63-74865 | | 4/1988 |
| JP | 1-214567 | | 8/1989 |
| JP | 8-245040 | | 9/1996 |

* cited by examiner

SECURITY CONTAINER FOR VALUE DOCUMENTS

BACKGROUND

A. Field

The present invention relates to a security container for receiving documents of value and in particular to a security container for storing documents of value in stack form.

B. Related Art

In the context of the invention documents of value are sheet-shaped objects, which, for example, represent a monetary value or an authorization. Important examples of such documents of value are coupons, vouchers, checks and in particular bank notes. Multiply used documents of value, in particular bank notes, can often be present in very different states, for example new or limp and/or crumpled by intensive use, which can make the automatic processing more difficult compared to the processing of only new paper.

Such documents of value, in particular bank notes, are often transported in a larger number, for example by security transport companies. For a protection against loss, the transport of the bank notes from a collecting point or a bank note processing apparatus to a receiving point is effected in security containers, from which the documents of value can be taken out without a destruction or manipulation of the security container preferably only by persons authorized to do this.

For the use in bank note processing apparatuses there are known special security containers which are provided with a sturdy housing which encloses a stacking pocket in which documents of value can be stacked that have been fed in a singled fashion. A known type of such security containers, which can also be referred to as free-fall security container, besides the stacking pocket is provided with a bottom element disposed in the stacking pocket, on which can rest a fed document of value or a stack of fed documents of value, and an inlet opening leading into the stacking pocket which is disposed such that documents of value fed to the security container, after having passed through the inlet opening, can fall onto the bottom element in the stacking pocket or at least a document of value carried by this, in particular a topmost document of value on a stack of documents of value carried by the bottom element. Here, one starts out from the inlet opening of the security containers in operation being aligned such that it is disposed in a direction parallel to the force of gravity, in the following also referred to as fall direction, above the bottom element.

When documents of value are fed to such a security container with high speed, there can occur transport troubles and/or stacking troubles, when documents of value after the passage through the inlet opening do not fall fast enough, in relation to the transport speed, in the direction of the bottom element and hinder the transport of a following document of value through the inlet opening. Moreover, a document of value can fall such that the result is not an orderly stack.

Therefore, the present invention is based on the object to provide a security container for storing documents of value which allows a good stacking of documents of value fed to it.

BRIEF SUMMARY OF THE DISCLOSURE

The problem is solved by a security container for storing documents of value in stack form having a stacking pocket for receiving documents of value in a stacked form, a bottom element disposed in the stacking pocket for carrying a fed document of value or a stack of fed documents of value, and an inlet opening leading into the stacking pocket which is disposed such that documents of value fed to the security container after having passed through the inlet opening fall onto the bottom element in the stacking pocket or at least a document of value carried by it, in particular a topmost document of value on a stack of documents of value carried by the bottom element. The security container is characterized in that in transport direction in or behind the inlet opening there is disposed at least partially at least one closing element with at least one portion which is deflectable from a closing position, in which it prevents a motion of a document of value completely entered into the stacking pocket back into the inlet opening, into a passing position in which it guides the document of value at least partially such that the document of value can reach into the stacking pocket and in which onto the portion there acts a restoring force driving towards the closing position, and which is movable against the restoring force into the passing position by a document of value fed through the inlet opening with a speed within a predetermined speed range.

The security container, which in operation is disposed such that the inlet opening, when viewed in fall direction, is disposed above the bottom element, is provided for the use with apparatuses which supply to the security container documents of value with a speed which can lie within a predetermined range. In this respect the security container and the apparatuses are adjusted to each other. Furthermore, one starts out from the security container being adapted for the use with documents of value of at least one predetermined type and a, in particular mechanical, state within a predetermined state spectrum. The predetermined state spectrum for example can be defined by a checking device in a processing unit for documents of value, which checks documents of value in particular in the form of bank notes as to their fitness for circulation and supplies documents of value into the security container only when they are fit for circulation.

For receiving stacked documents of value the security container is provided with the stacking pocket, in which the documents of value can be stacked, in a housing at least protected against simple acts of violence. The documents of value are fed to the stacking pocket through the inlet opening which can be limited by a respective opening in a housing portion which limits the stacking pocket, or one movable element and one element firmly connected with the housing or two movable elements in the security container.

The closing element is disposed at least partially, i.e. at least with the portion, in the inlet opening or in transport direction behind the inlet opening in the area of the transport path of a document of value entering the stacking pocket through the inlet opening. Such a document of value, which has a speed in a predetermined speed range, thus enters in or through the inlet opening and meets the closing element or at least the portion of the closing element. By its momentum it moves at least the portion of the closing element from the closing position, against the restoring force which preferably increases with increasing deflection, into the passing position, so that the document of value is guided by the deflected closing element or the deflected portion. Here, the free end of the portion is moved preferably by at least 0.2 millimeters. Such guidance can be effected, for example, solely in that an edge of the portion exerts force on the document of value or a portion of it. At least in this stage the transport path from the inlet opening into the stacking pocket is at least partially released for the further transport. The momentum results from the properties, in particular also the mechanical state, of the document of value and the speed of the document of value, so that a range for possible speeds of the documents of value suitable for the function of the closing element in conjunction with the kind or the type and the state of the documents of value is predetermined. The properties of the closing element and the speed range as well as the kind or the type of the documents of value, therefore, are adjusted to each other.

After the trailing edge of the document of value, when viewed along the transport direction, has passed the closing element, the restoring force caused by the deflection pushes the closing element or the portion back into the closing position, which at the same time represents an idle position, in which no document of value acts on the closing element. The closing element is formed and disposed such that in the closing position, in which it is not deflected by a document of value, it prevents a motion of a document of value completely entered into the stacking pocket back into the inlet opening. Such a motion can occur, for example, when the document of value is thrown back in the direction of the inlet opening by a side wall of the stacking pocket. The closing element thus ensures that the completely entered document of value can fall in the direction of the bottom element without colliding with a front edge, when viewed in transport direction, of a following document of value. This permits that the process is less prone to transport troubles and a good stack quality.

In principle, the closing element can be disposed and formed in any fashion, as long as it fulfils the above-mentioned functions. In particular, it is conceivable that the closing element or the portion of it is deflected at least partially against the fall direction by a document of value entering through the inlet opening. But preferably, the closing element is formed and disposed such that it diverts a document of value moved through the inlet opening with the speed within the predetermined range against the fall direction in a direction towards the bottom element. This embodiment has the advantage that a following document of value reaches into the stacking pocket with a very high reliability above the document of value and thus the risk of troubles occurring during the stacking process is reduced. In particular, the closing element can be formed and disposed such that when moving back into the closing position it or the portion exerts a force, which points at least with one component in fall direction, on an area of the falling document of value and separates it still clearer from the following document of value. Moreover, this impedes possible manipulation attempts at the security container, with which the stacked documents of value are to be taken from the security container by means of an instrument inserted through the inlet opening.

The restoring force can be produced in any fashion by a restoring force arrangement. In particular, three preferred variations of restoring force arrangements are stated in the following paragraphs, which arrangements can also be combined so that the restoring force has differently produced contributions.

According to the first variant the closing element is formed and disposed such that the restoring force is given at least partially by the force of gravity acting on the closing element and/or a portion of the closing element or a body mechanically coupled with the closing element or the portion of the closing element. This is of advantage when no special, for example elastic, material is to be used for producing the restoring force. In particular, a fatigue of such a material can be prevented. Here, the force of gravity in particular can exert a respective torque on the closing body or the portion of the closing body.

According to the second variant, at the security container there is provided an elastic restoring element, which in the case of a deflection of the closing element or of the portion of the closing element is tensioned from the closing position into the passing position and pushes the deflected closing element or the portion in the direction of the closing position Such a formation is advantageous, in particular, when larger closing elements or certain materials are to be used for the closing element.

In the third variant, the closing element comprises a resilient area connected with the portion, so that when a document of value passes through the inlet opening, the portion is deflectable under the deformation of the resilient area. This variant is in particular characterized in that an especially simple and thus also more sturdy structure of the security container can be achieved with a smaller number of parts. For example, the closing element only needs to be formed and produced of an elastic material such that it is fastenable with a fastening area in or at the apparatus. Then the free end can constitute the portion for diverting the document of value, while the area located between the free end and the fastening area is resilient. For example, the closing element can be given by a resilient sheet metal or a resilient metal strip. Especially preferred, the closing element is formed of a plastic foil. As plastic materials, for example, polyolefins, in particular polyethylene and polypropylene, and technical plastic materials, for example polyethylene terephthalates or polyether ketones, are suitable. For achieving the desired restoring force, the thickness and length of the foil then can be chosen in dependence on the flexural modulus of the material.

Furthermore, the closing element can have at least one fiber which diverts the document of value while being deformed itself. But preferably, the closing element has an areal form at least in the area which comes into contact with the document of value.

In particular when a closing element is used which diverts a document of value in an upward direction with respect to the fall direction, but not restricted to it, the security container preferably has at least one guide element with a guide portion which is inclined in the direction towards the bottom element, and the closing element is disposed relative to the guide element such that it presses a document of value against the guide element, in particular the guide portion. This has the advantage that the document of value, in a way that is favorable for the further fall in the direction towards the bottom element, at least partially can be guided by both the deflected closing element or its portion and the guide portion. The friction with the closing element and the guide portion effects that the document of value is further slowed down, so that a bouncing back from a wall opposite the inlet opening in the direction of the inlet opening occurs with reduced power or preferably not at all. Thus, collisions with following documents of value caused by a bouncing back or a bad stack quality can be prevented.

Furthermore, it is preferred that at least one further flexible or movably held, in particular resilient or resiliently held, diverting element is disposed such that at least a portion of the diverting element is deflectable from an idle position by a document of value, which has at least partially passed the closing element disposed in or behind the inlet opening, in a direction away from the bottom element. By the deflection of the diverting element there also occurs a diversion of at least a portion of the document of value in the direction towards the bottom element. Especially preferred, the deflection also effects a slow down of the document of value in a direction parallel to the transport direction in the inlet opening. If from the deflection of the diverting element out of the idle position there results a back-driving force towards the idle position, for example caused by the force of gravity, a resilient material of at least a part of the diverting element or the resilient mounting device of the diverting element, preferably with the return into the idle position there can also be exerted a momentum on the document of value in the direction towards the bottom element, which leads to a more favorable fall path. The person skilled in the art can determine by tests a suitable arrangement and formation of the diverting element for predetermined types of documents of value and the predetermined speed range. The diverting element in particular can be disposed before the guide element or in the area of the guide element.

For the formation of the diverting element the same embodiments as for the closing element are conceivable, an embodiment in the form of a foil being preferred by reason of the advantage of the easier production and mounting.

In principle it is possible that the inlet opening in the security container is disposed such that documents of value can be fed to this security container through the inlet opening. But the security container can also comprise an input opening for documents of value and a transport path given by a guiding device leading from the input opening to the inlet opening. Here, the transport path not necessarily has to extend linearly, rather, it is possible that the transport direction is changed for example by 90°.

Especially preferred, the security container then comprises a transport system for transporting documents of value from an input opening to the inlet opening. Such a development, depending on the design, involves a series of advantages. The transport system at the same time can act as a guiding device in the above-mentioned way. Moreover, the drive unit can be driven such that documents of value reliably enter into the inlet opening with a speed lying within the predetermined range, so that fluctuations in the speed with which documents of value are fed to the security container do not have any or in any case only a minor influence on the stack quality.

A method for stacking documents of value in a security container according to the invention having the mentioned transport system is also subject matter of the invention, wherein at least one document of value is fed to the security container with an input speed and transported by the transport system through the inlet opening with a transport speed which is greater than the input speed. This method has the advantage, that the document of value during the transport in the security container is stretched, when it is a little crumpled, and thus enters through the inlet opening in a state more favorable for the stacking.

Driving the transport system, in principle, can be effected in any way.

According to an alternative it is possible that the security container itself is provided with a drive unit for the transport system, for example an electric motor, which is controllable via a control system or a control interface of the security container. The controlling can be effected, for example, by an apparatus for processing documents of value, which feeds documents of value to the security container. This development is especially advantageous when the security container is to be used with different types of apparatuses for processing documents of value.

In another embodiment the transport system has a coupling element for the detachable coupling to a coupling element of an external drive. This embodiment, on the one hand, has the advantage that the security container can be constructed lighter and more economical. On the other hand, in particular when a drive is effected by an apparatus for processing documents of value which feeds documents of value to the security container, it is easier to adjust the input speed, with which documents of value are fed to the security container, and the transport speed in the security container to each other.

The two above-mentioned possibilities for drives can be present alternatively or in combination.

In principle, the bottom element of the security container can be stationary and, for example, given by the bottom of a security container housing. But preferably, the security container is provided with a movable bottom device, which comprises the bottom element as a movable bottom which is movable in a stacking direction. Besides the bottom element the movable bottom device can comprise, for example, a guidance for guiding the movable bottom in the stacking pocket and, optionally, a gear unit.

The movable bottom, in principle, can be moved in any way. In a preferred embodiment the security container further comprises a drive unit for moving the movable bottom. Such embodiment has the advantage that moving the movable bottom can be effected independently of a mechanical interface and therefore can be used for a wider range of apparatuses for processing documents of value. Here, the drive unit can act directly at the movable bottom, for the purpose of which it can be formed for example as a linear motor or drive the movable bottom device. For supplying the drive unit with energy and/or for activating, in particular there can be provided a respective interface in or at the security container.

The use of a linear motor permits an especially simple structure of the security container. Subject matter of the present invention therefore is also a security container which has the form of a free-fall security container, in particular a security container for storing documents of value in stack form with a stacking pocket for receiving documents of value in a stacked form, a bottom element disposed in the stacking pocket for carrying a fed document of value or a stack of fed documents of value, and an inlet opening leading into the stacking pocket which is disposed such that documents of value fed to the security container after having passed through the inlet opening in the stacking pocket fall onto the bottom element or at least a document of value carried by it, in particular a topmost document of value on a stack of documents of value carried by the bottom element, which has a movable bottom device which comprises the bottom element as a movable bottom which is movable in a stacking direction, and which has a linear motor for moving the movable bottom. The movable element of the linear motor preferably is connected directly with the bottom element or a carrier for the bottom element. Preferably, the linear motor has the form of a stepper motor. Such a security container in particular can also have at least one of the already mentioned features and/or the features mentioned in the following independently of other features or in combination with other mentioned features, the combination in particular not necessarily having to have the feature of the closing element. But also with such a container preferably in transport direction in or behind the inlet opening there is disposed at least partially at least one closing element with at least one portion which is deflectable from a closing position, in which it prevents a motion of a document of value completely entered into the stacking pocket back into the inlet opening, into a passing position in which it guides the document of value at least partially such that the document of value can reach into the stacking pocket and in which onto the portion there acts a restoring force driving towards the closing position, and which is movable against the restoring force into the passing position by a document of value fed through the inlet opening with a speed within a predetermined speed range.

In a different preferred embodiment which can also be combined with the above-mentioned embodiment, the movable bottom device has a coupling element for a detachable coupling to a coupling element of an external drive unit, by means of which the movable bottom is movable. Such embodiment has the advantage, that the security container is lighter and can be manufactured more economically, since the drive unit is external and thus only has to be operated when filling the security container.

When the security container includes a movable bottom device it is preferred that it further has a detection unit, by means of which it is determinable whether the bottom element is in a position, in which the upper side of a stack of documents of value carried by the bottom element assumes a predetermined position. Such embodiment has the advantage that during an input of documents of value or a deposit or after each input or deposit of a number of documents of value, the movable bottom or the bottom element can be moved in a position which is favorable for stacking not fed documents of value. This permits a better stack quality and reduces possible malfunctions. The detection unit, for example, can comprise a light barrier or a light scanner, the optical path of which extends approximately in parallel to the surface of the movable bottom. Here, light means any optical radiation, besides visible light also ultraviolet and in particular infrared light. But, in principle, the use of detection units working on a different basis, for example on an ultrasound basis, is also conceivable The security container, in particular the inlet opening as well as the closing element or the closing elements and, to the extent that they are provided, the input opening and the transport system in principle can be adapted to be used with documents of value having a rectangular oblong form, in particular bank notes, which are transported with their longer side in parallel to the transport direction, i.e. in longitudinal transport. But preferably, by means of respective arrangements and the design of its components, the security container is adapted to transport rectangular documents of value with their shorter side in parallel to the transport direction, i.e. transversely.

DESCRIPTION OF THE DRAWINGS

In the following the invention is still further explained by way of example with reference to the Figures.

DETAILED DESCRIPTION OF PREFERRED EMBODIMENTS OF THE INVENTION

Figure 1:
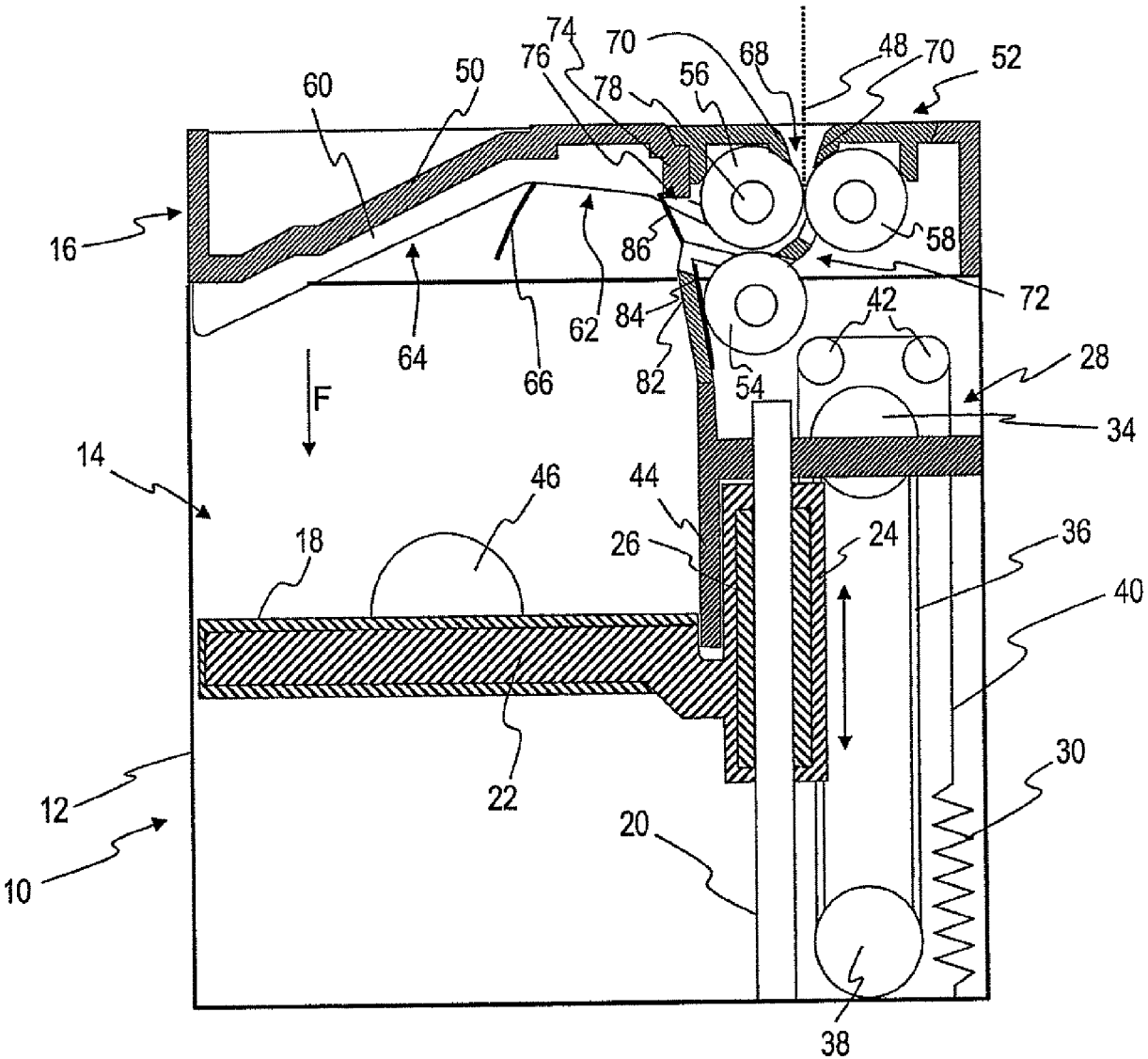
FIG. 1 shows a schematic sectional representation of a security container according to a first preferred embodiment of the invention.
Figure 4:
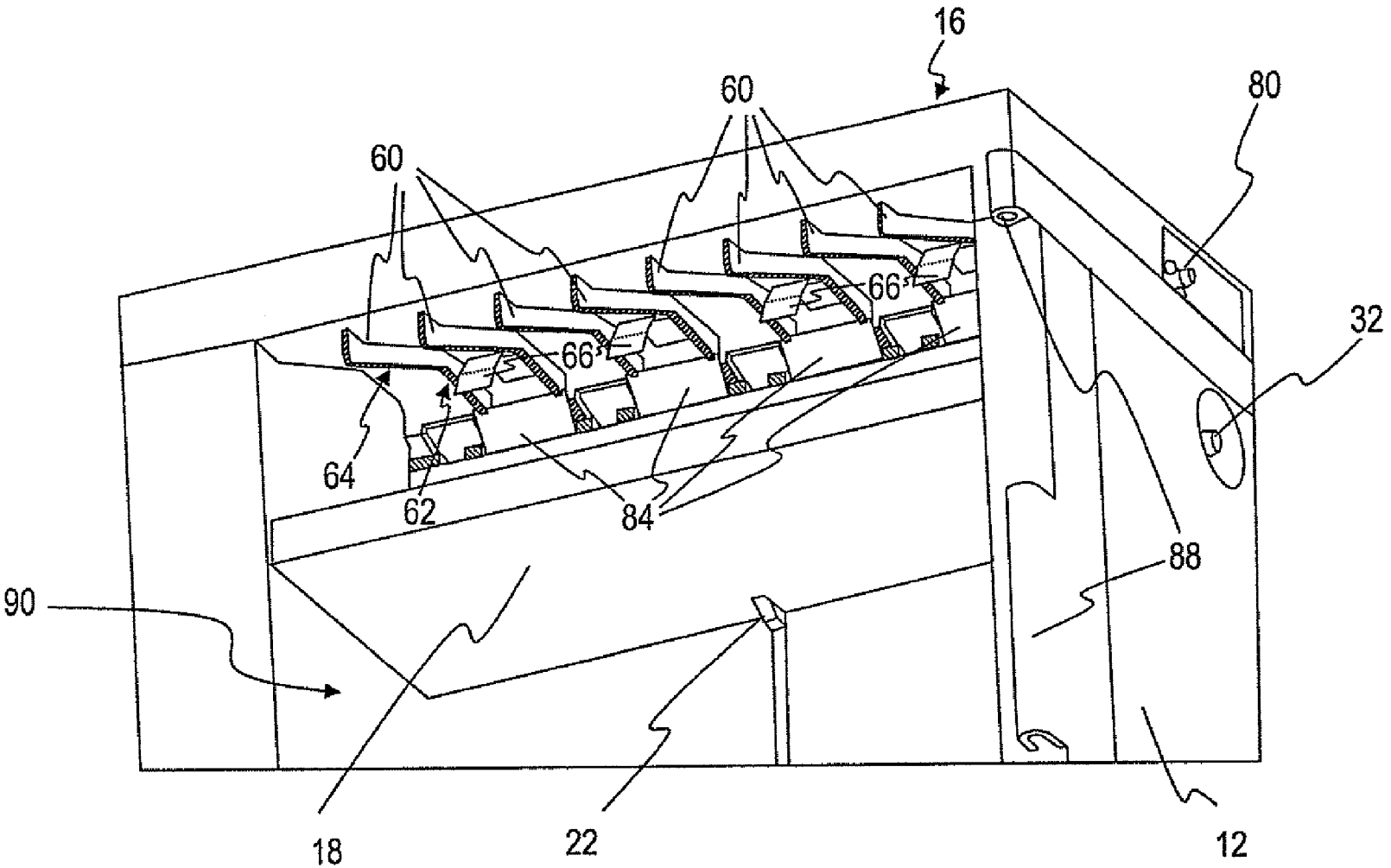
FIG. 4 shows a perspective, schematic, partial view of the security container in FIG. 1 viewed from obliquely below through a remove opening of the security container.

A security container in FIG. 1 and FIG. 4 comprises a housing 10 with a bottom part of the housing 12 which encloses a stacking pocket 14 from five sides, an upper part of the housing 16 closing the bottom part of the housing 12 and upwardly limiting the stacking pocket 14, and a movable bottom device with a bottom element 18 in the form of a movable bottom which can be moved up and down in the stacking pocket 14 and on which documents of value, in this embodiment bank notes, can be stacked.

The bottom part of the housing 12, which is produced of a sturdy material suitable for a security container, besides the bottom element 18 comprises a linear guide device 20, in this example a rod, at which is guided in a linearly movable fashion a carrier 22, which carries the bottom element 18. Here, the linear guide device 20 is disposed such that the bottom element 18 is movable up and down in vertical direction or fall direction F along a stacking direction in the stacking pocket 14, when the security container is correctly mounted. The carrier 22 is provided with a cylinder portion 24 encompassing the linear guide device 20, which accommodates a bearing bush 26 guided at the linear guide device 20.

In the bottom part of the housing 12 there is further provided a drive unit 28, which serves to move the bottom element 18. In this embodiment the actual driving is effected via an external motor disposed in a bank note processing machine not shown in the Figures and a pretensioning device 30 for exerting a force acting against the fall direction on the bottom element 18, in this example a spring element, which in case of a motion of the bottom element 18 is tensioned by the motor in the direction of the bottom of the bottom part of the housing 12.

For a coupling to coupling elements of the bank note processing apparatus connected with the motor, in the bottom part of the housing there is provided a shaft 34 with a pulley connected with a coupling element 32 (cf. FIG. 4). The cylinder portion 24 of the bottom element 18 accommodating the bearing bush 26, at ends located opposite each other in the direction of the linear guide device, is connected to a belt 36, which is guided via the pulley of the shaft 34 and a further pulley 38 mounted to be freely rotatable, so that depending on the rotating motion of the shaft 34 the carrier 22 and thus the bottom element 18 carried by the carrier 22 is moved up and down.

The spring element 30, which in this embodiment can be tensioned and the tension of which can be released in a direction parallel to the direction of the linear guide device, is also coupled with the bottom element 18 via a belt 40, which is guided via two deflection pulleys 42, for the purpose of which the belt 40 is connected with an upper area of the cylinder portion 24. As mentioned above, the length of the belt 40 is chosen such that when the shaft 34 is released when the bottom element 18 is moved upward.

The upward movement of the bottom element 18 here is limited by a housing element 44 which acts as a stop for the carrier 22.

Furthermore, in the bottom part of the housing 12 are disposed elements of a detection unit, by means of which it is determinable whether the bottom element 18 is in a position in which the top side of a stack of bank notes carried by the bottom element 18 assumes a predetermined position. In this embodiment the detection unit comprises a reflection light barrier, which comprises a transceiver device and a reflector 46 not shown in the Figures disposed at opposite walls of the bottom part of the housing 12, and the signals of which, which represent the presence or absence of the predetermined position, are transmittable via a not shown interface to the bank note processing apparatus. More precise, the light barrier is disposed in the bottom part of the housing 12 such that by means of the light barrier it is determinable, whether the bottom element 18 is in a stacking position, i.e. whether above the bottom element 18, when there are still not stacked any bank notes on it, or above the topmost bank note of a stack of bank notes stacked on the bottom element 18 there is still sufficient space for stacking a predetermined number of bank notes, in the example two hundred bank notes. The appropriate height above the bottom of the bottom part of the housing 12 or the distance to the upper part of the housing 16 in which the light barrier has to be disposed relative to it can be determined in dependence on the type and expected state of the bank notes to be fed to the security container.

The upper part of the housing 16 does not only serve to close the bottom part of the housing, but also contains the transport system or respective elements and devices provided for the transport of fed bank notes 48 into the stacking pocket 14.

The upper part of the housing 16 comprises a base member 50, in the example a molded plastic part, an inset 52 inserted in an opening of the base member 50 with a transport path which provides a diversion of more than 90°, and transport rollers 54, 56 and 58 mounted at the inset 52 as a part of the transport system for the transport of fed bank notes into the stacking pocket 14.

The base member 50 is formed such that it closes the bottom part of the housing 12, the opening of the base member 50 being disposed beside the stacking pocket. Furthermore, in the area facing the stacking pocket 14 there are formed rib-like guide elements 60 substantially extending in parallel to each other, along a transport direction of the bank notes when entering the stacking pocket 14, in FIG. 1 from the right to the left, each of them having a first guide portion 62 at first rising relative to the bottom element 18 and then a second following guide portion 64 inclined in the direction towards the bottom element 18.

Approximately in the area of the junction from the first guide portions 62 to the second guide portions 64 between the guide elements 60 there are disposed elastic diverting elements 66 in the form of strips of a plastic foil aligned with one side at right angles and another side in parallel to the guide elements 60 and thus the transport direction, which in the idle state, i.e. when no document of value is in contact with them, are inclined in transport direction towards the bottom element 18.

The inset 52, too, is a molded plastic part with a feed portion which forms opposite upper guide surfaces 70 forming a tapering feed gap 68. Here, the feed gap 68 is aligned such that documents of value are feedable into the feed gap 68 in an input direction, in the example from above or in parallel to the fall direction F.

After the feed portion there follows a transport portion 72, which as a guide section diverts bank notes 48 fed through the feed gap 68 from the vertical direction into a direction facing away from the bottom element 18, in FIG. 1 obliquely upward, at an angle of more than 10°, in the example approx. 15°, towards the bottom element 18.

The end of the transport portion 72 together with a crosspiece 74 at the base member 50 forms an inlet opening 76, through which fed documents of value are transportable into the stacking pocket 14.

The transport portion 72 has oblong openings extending in the moving direction of the documents of value, through which the transport rollers 54, 56 and 58 grip. The transport rollers 54, 56 and 58 are formed and disposed such that a fed document of value at first is clamped between the transport rollers 56 and 58 and in the course of the transport between the transport rollers 56 and 54 and in each case is further transported by these.

For this purpose from these transport rollers the transport roller 56 is drivable via a shaft 78 with a coupling element 80. The coupling element 80 is disposed outside the housing 10, so that a complementary coupling element of the bank note processing apparatus, in which the security container is inserted, can transmit the rotation of a drive of the bank note processing apparatus to the coupling element 80 and thus the transport roller 56, when the complementary coupling element and the coupling element 80 are engaged. The use of an external drive permits a good adjustment of the rotating speed of the transport rollers 54, 56 and 58 and thus the transport speed of the documents of value in the security container to the transport speed out of the bank note processing apparatus.

After the transport portion 72 there follows a hold portion 82, at which are held equally formed inlet opening closing elements 84 distributed side by side over the width of the documents of value. The closing elements 84, in the example likewise elastically deformable i.e. resilient plastic foil strips, are formed and disposed such that directly behind the inlet opening 76 facing away from the bottom element 18 obliquely in transport direction a portion 86 at a time rests against the crosspiece 74 and thus closes in an idle or closing position the inlet opening 76.

For removing documents of value the security container is provided with hinges 88 at the upper part of the housing 16 and the bottom part of the housing 12, at which a door is linked for clarity's sake not shown in the Figures, by means of which a remove opening 90, which is formed by recesses in the upper and bottom part of the housing, is closable.

The security container is further provided with a locking device not shown in the Figures, by means of which the door is lockable in a closed position in which it closes the remove opening. Preferably, the locking device has a known structure such that only authorized persons have access to the stacking pocket 14.

For storing documents of value in the security container, with the help of the detection unit, i.e. here the light barrier, and the bank note processing apparatus the bottom element 18 is driven downward until it has reached a stacking position, or a stack of documents of value lying thereon has a predetermined distance to the upper part of the housing 16, more precise the guide elements 60. When feeding singled documents of value from vertically above into the feed gap 68, the following happens:

A document of value 48 (cf. FIG. 1) entering with an input speed within a predetermined speed range through the entry gap 68 is clamped between the transport rollers 56 and 58 and sliding over the surface of the transport portion 72 and diverted by these it is fed to the transport roller pairs 54 and 56. In this stage the portions 86 of the closing elements 84 are in a closing position, in which they resiliently rest against the crosspiece 74 and partially close the inlet opening 76 such that documents of value or bank notes cannot reach out of the stacking pocket into the inlet opening.

Figure 2:
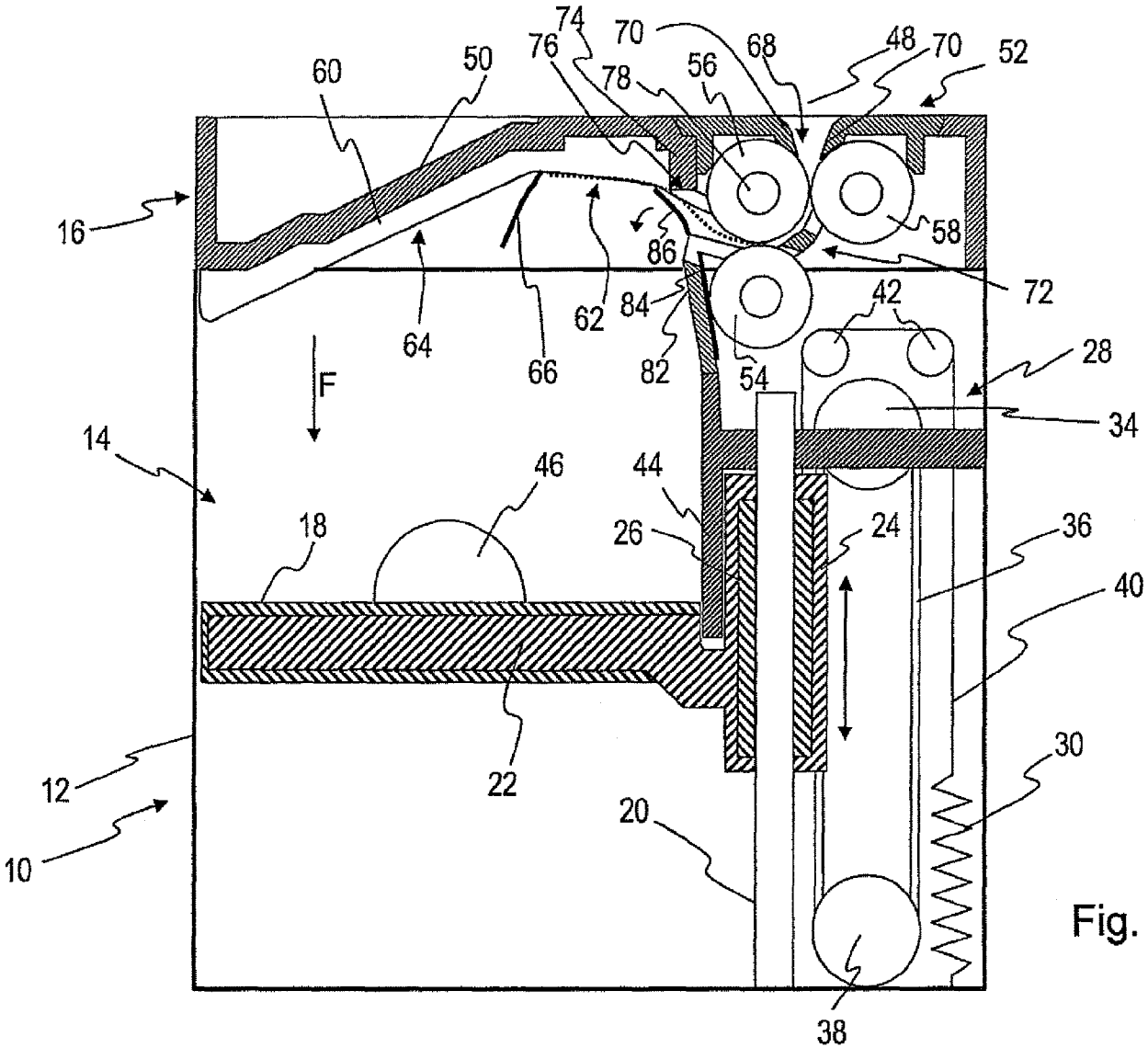
FIG. 2 shows a schematic sectional representation of the security container in FIG. 1 at a point in time at which a bank note transported into the security container deflects a closing element of the security container into a passing position.
Figure 3:
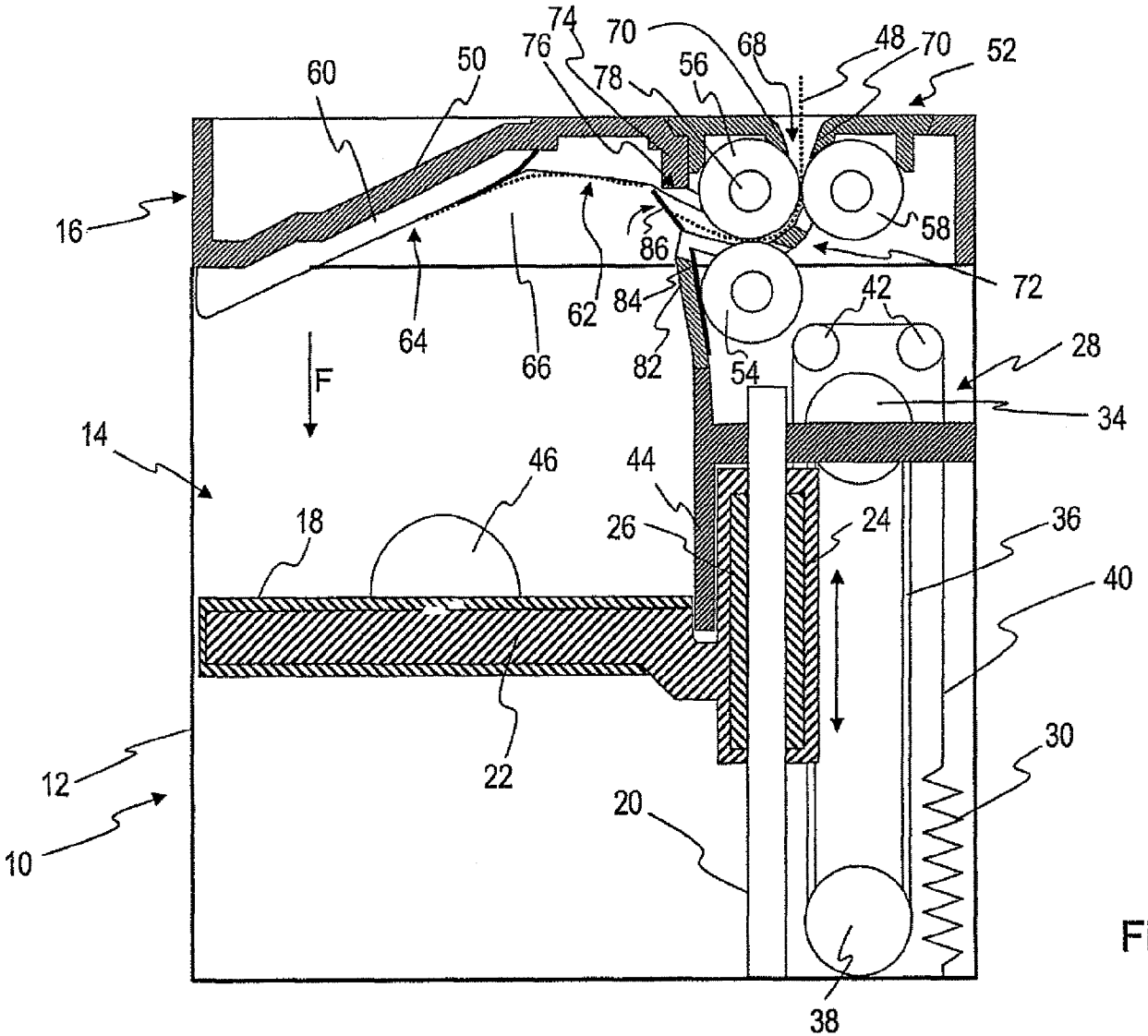
FIG. 3 shows a schematic sectional representation of the security container in FIG. 1 at a point in time at which the bank note transported into the security container deflects a diverting element of the security container.

In the further transport then the transport roller pairs 54 and 56 grasp the document of value 48 and push it through the inlet opening 76, the portions 86 of the closing elements 84 being deflected against a back-driving elastic force under the deformation of the closing element 84 in the direction of the bottom element 18 into a passing position (cf. FIG. 2). In other words, since the inlet opening closing elements 84 have a resilient area portion fixedly coupled to the hold portion 82, i.e., fixed so that the resilient area of the closing element 84 is fixed in a stationary position with respect to the housing, the closing element portion 86 of the closing element can deflect in the direction of the bottom element 18. The surface of the closing elements 84 and their bending stiffness is chosen such that with a transport speed in a predetermined speed range and for predetermined types of documents of value with permissible state, for example fit for circulation, the portions 86 of the closing elements 84 guide, preferably press, the document of value 48 against the guide elements 60 and thus slow down the speed of the document of value 48. The bending stiffness can be influenced, for example, by the choice of the foil material and the thickness of the foils. The range for the bending stiffness of the foils can lie, for example, in the range of the bending stiffness of the documents of value, for which the security container is to be used, or can be a little greater.

When the document of value 48 no longer is clamped by the transport roller pairs 54 and 56 and thus actively transported, it moves further due to its inertia, slowed-down and guided by the portions 86 of the closing elements 84 as well as the first guide portions 62.

It then meets the diverting elements 66, which are deflected against a back-driving force given by the force of gravity and an elastic deformation force in the direction away from the bottom element 18. In this stage the document of value 48 is diverted by the diverting elements 66 and by the second guide portions 64, at which it is guided in a sliding fashion, in the direction toward the bottom element 18.

When in this stage the trailing edge of the document of value 48 has passed the edges of the portions 86, these are moved by the back-driving forces from the passing positions again into the closing positions, in which the inlet opening 76 is partially closed. Now it is no longer possible that the document of value 48 fed to the stacking pocket 14 can be moved back through the inlet opening 76.

Then the document of value 48 falls onto the bottom element 18 or the topmost document of value of a stack of documents of value stacked on the bottom element 18.

After the end of the feed of documents of value the bottom element 18 again is moved into the next stacking position by means of the external drive. In a different development, however, at first the bottom element can be moved up to the top by means of the pretensioning device 30, so as to press together the newly stacked documents of value. Then, the bottom element 18 is moved into the next stacking position with the help of the light barrier by means of the external drive.

So as to avoid, as far as possible, an electrostatic charging of the closing elements 84 and the diverting elements 66, these are provided, at least in the portions that come into contact with the documents of value, with an antistatic for example electrically conductive coating.

Figure 5:
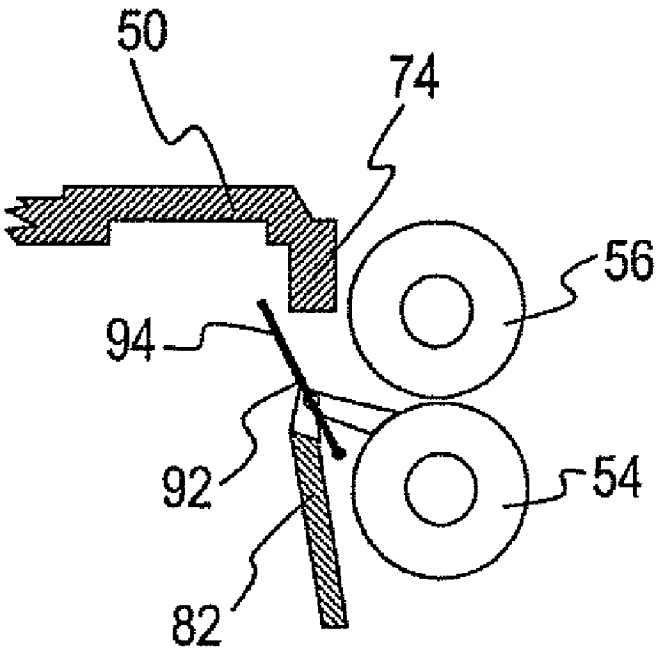
FIG. 5 shows a schematic sectional view of a portion of a security container according to a second preferred embodiment of the invention in the area of a closing element.

A security container according to a second preferred embodiment of the invention in FIG. 5 differs from the first embodiment in the formation of the closing elements. All other parts are unchanged and the same reference signs are used for them.

Now, instead of the elastically deformable closing elements 84 rigid closing elements 92 are provided, which are mounted like a two-armed lever rotatable in a damped fashion at the transport portion 72 in the area of the inlet opening 76. The closing elements 92 are formed and mounted such that a back-driving moment of inertia is exerted on them by the force of gravity, which turns the closing elements 92 into the closing position, when no document of value exerts a force on the closing elements 92. For this purpose, at their end not coming into contact with the bank notes they can be optionally provided with an additional weight or an appropriate body. In the closing position the portions 94 partially close the inlet opening 76 analogous to the portions 86. But when a document of value with a speed in a predetermined speed range meets the portions 86, these are moved into a passing position in which the portions 94 press the document of value against the guide elements 60. Because of the damping a swinging of the closing elements is avoided.

Figure 6:
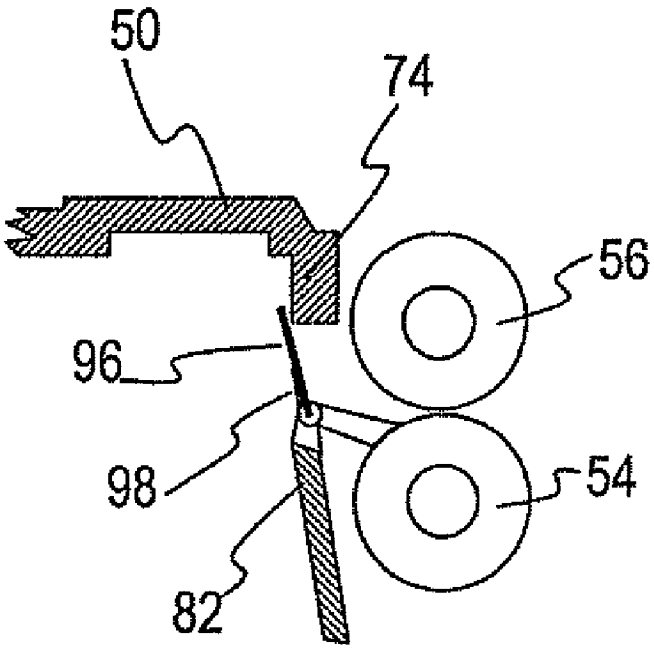
FIG. 6 shows a schematic sectional view of a portion of a security container according to a third preferred embodiment of the invention in the area of a closing element.

A security container according to a third preferred embodiment of the invention in FIG. 6 differs from the first embodiment again in the formation of the closing elements. All other parts are unchanged and the same reference signs are used for them.

Instead of the closing elements 84 now closing elements 96 are provided, which are rotatably mounted like a one-armed lever at the transport portion 72 in the area of the inlet opening 76. Spring elements 98, for example leaf springs, are disposed before each of the closing elements 96 such that they press the closing elements 96 to the crosspiece 74 into a closing position, but with the impact of a document of value with a speed in a predetermined speed range they allow a motion against a back-driving force into a passing position in which the document of value can enter through an inlet opening 76 into the stacking pocket 14, the document of value being pressed against the guide elements 60.

Although the security container, in principle, can be formed such that rectangular documents of value can be fed to it with their longer side in transport direction, i.e. in the longitudinal transport, preferably it is formed for the feed of documents of value in the transverse transport, i.e. with the longer side at right angles to the transport direction.

Still further embodiments differ from the embodiments explained above in that though the diverting elements are flexible they are not elastic to a worth mentioning extent. The back-driving force then is only effected by the force of gravity.

With still further embodiments the drive unit with the components 34, 36 and 38 is replaced by a linear motor, which is controllable by a bank note processing apparatus via an interface located at the outside of the housing.

Further embodiments differ from the above-described embodiments in that the transport system comprises two roller pairs, which are driven such that the in transport direction first roller pair transports a document of value a little faster, preferably between 1% and 10% faster, than the second. If a document of value is fed to the security container with an input speed in a predetermined speed range, the front end of the document of value will be transported through the inlet opening with a transport speed which is greater than the input speed and the transport speed after the first roller pair. The document of value is stretched during the transport in the security container, when it is a little crumpled, and thus moves through the inlet opening in a state more favorable for the stacking.

Figure 7:
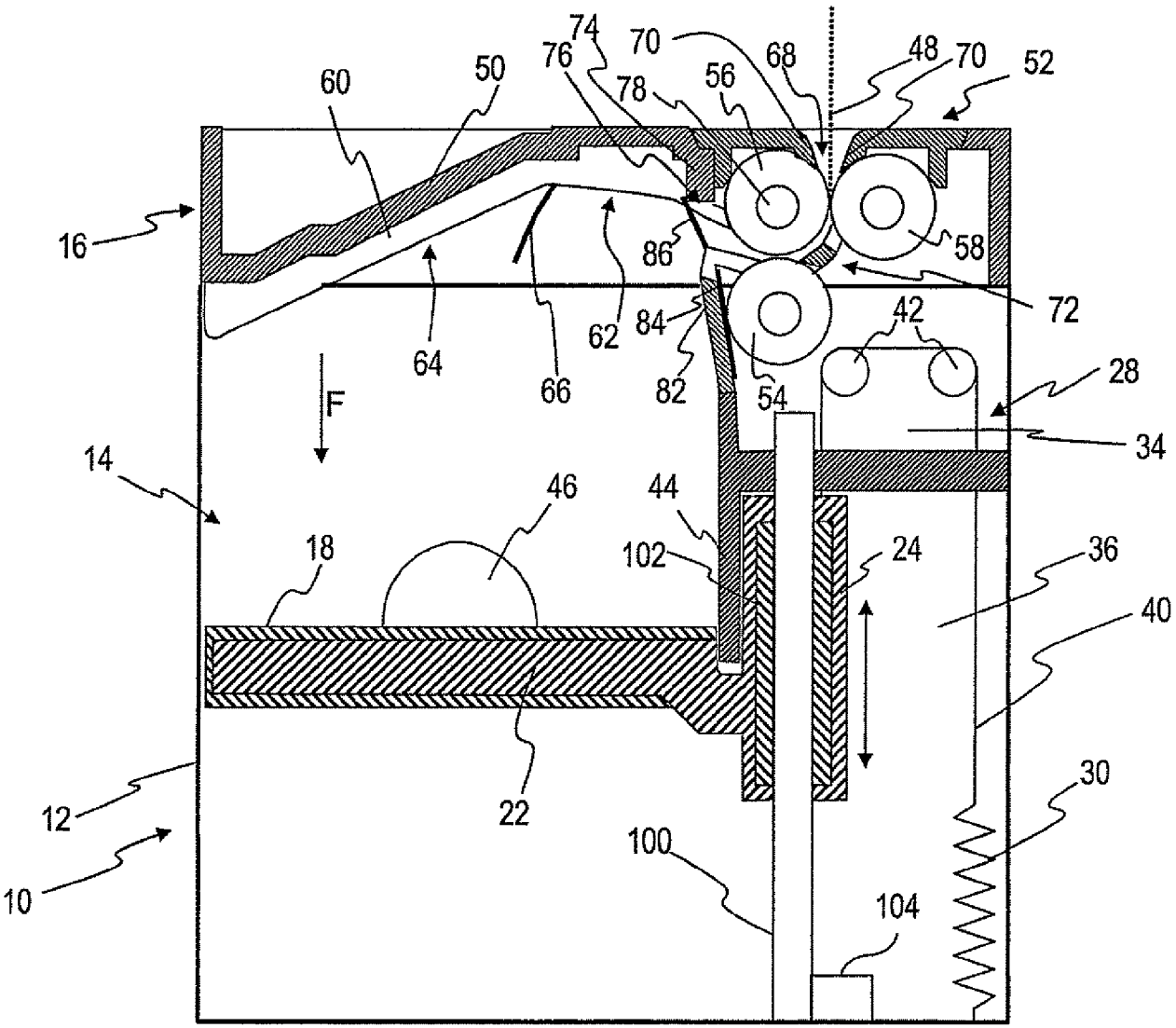
FIG. 7 shows a schematic sectional representation of a security container according to a further preferred embodiment of the invention with a linear motor.

Still further embodiments differ from the above-mentioned embodiments in that for driving the bottom element 18 or the carrier 22 is provided. This shall be illustrated with the example of the security container in FIG. 7, which otherwise does not differ from the security container in FIG. 1, so that for the same parts the same reference signs are used and the explanations for the parts are also valid for this embodiment. Coupling element 32, shaft 34, roller 38 and belt 36 are left out here. Instead, the rod 20 is replaced by the static element 100 of a linear motor. Furthermore, the bearing bush 26 is formed as a moved element 102 of the linear motor, so that the carrier 22 is movable by activating the linear motor. For activating the security container is provided with an interface 104, which in this embodiment is disposed in the bottom area, but in general can also be mounted at other suitable places. The element 100 in particular can also serve as a guide element for the carrier 22 or the bottom element.

With a still further embodiment the pretensioning device 30 with belt 40 and deflection pulleys 42 is also left out. Instead, the linear motor is formed as a stepper motor.

The security container in each case is designed for using predetermined types of documents of value being in a predetermined range of states of the documents of value. The properties and arrangement of the closing elements or the spring elements have to be adjusted in dependence thereon for the predetermined speed range, for the purpose of which the person skilled in the art can carry out respective tests.

The invention claimed is:

1. A security container for storing documents of value in stack form, comprising:

a housing;

an input opening for receiving fed documents of value;

a stacking pocket arranged to receive fed documents of value in a stacked form from the input opening;

a bottom element disposed in the stacking pocket arranged to carry a fed document of value or a stack of fed documents of value;

an inlet opening leading into the stacking pocket which is disposed downstream of the input opening in a document feed direction such that documents of value transported to the security container after having passed through the inlet opening fall onto the bottom element in the stacking pocket or onto a topmost document of value carried by the bottom element;

a guide section fixed to the housing having a first end and a second end, said guide section arranged to lead documents of value from the input opening at the first end to the inlet opening at the second end;

transport rollers associated with the guide section rotatable relative to the housing;

at least one inlet opening closing element disposed at least partially in or behind the inlet opening and behind the transport rollers relative to the document feed direction, said at least one inlet opening closing element comprising at least one closing element portion which is deflectable from an idle closing position by fed documents of value moving through the inlet opening at a speed within a predetermined speed range and a resilient area portion connected to the closing element portion, said resilient area portion coupled to the second end of the guide section fixed to the housing and connected for pivotal or bending movement of the closing element portion relative to the housing and, at which closing position the at least one closing element portion blocks reverse passage of a document of value that has completely entered into the stacking pocket back towards and into the inlet opening, to a deflected passing position at which the closing element guides a document of value at least partially such that at least a portion of such document of value extends into the stacking pocket;

and a restoring force arrangement which acts on the closing element portion and the resilient area portion when deflected by a document of value to a passing position to exert a restoring force urging the closing element portion back towards the idle closing position so that when a document of value passes through the inlet opening, the closing element portion is deflected due to a deformation of the resilient area portion.

2. The security container according to claim 1, wherein the inlet opening closing element is arranged to divert a document of value moved through the inlet opening against a fall direction.

3. The security container according to claim 1, including at least one guide element with a guide portion which is inclined in the direction towards the bottom element, and wherein the inlet opening closing element is disposed relative to the guide element such that it presses a document of value against the guide element.

4. The security container according to claim 1, wherein at least one further flexible or movably held diverting element is disposed such that at least a portion of the diverting element is deflectable from the idle closing position in a direction away from the bottom element by a document of value which has at least partially passed the inlet opening closing element disposed in or behind the inlet opening.

5. The security container according to claim 1, wherein the inlet opening is formed and disposed relative to the stacking pocket such that documents of value are transportable with their shorter side extending in the document feed direction through the inlet opening.

6. The security container according to claim 1, including a transport system operable to transport documents of value from an input opening to the inlet opening.

7. The security container according to claim 6, wherein the transport system has a transport coupling element arranged to be detachably coupled to an external drive coupling element of an external drive.

8. The security container according to claim 1, including a movable bottom device which comprises the bottom element as a movable bottom which is movable in a stacking direction.

9. The security container according to claim 8, including a drive unit operable to move the movable bottom.

10. The security container according to claim 8, wherein the movable bottom device has a bottom device coupling element arranged to be detachably coupled to an external drive coupling element of an external drive unit operable to move the movable bottom.

11. The security container according to claim 8, including a detection unit operable to determine whether the bottom element is in a position at which the topside of a stack of documents of value carried by the bottom element has assumed a predetermined position.

12. The security container according to claim 1, wherein the guide section further comprises a crosspiece coupled to the housing downstream the inlet opening and transport rollers arranged in a way so that in the closing position, the closing element rests against the crosspiece, and in the passing position, the closing element does not rest on the crosspiece.

13. A security container for storing documents of value in stack form, comprising:

an input opening for receiving fed documents of value;

a stacking pocket arranged to receive fed documents of value in a stacked form from the input opening;

a bottom element disposed in the stacking pocket arranged to carry a fed document of value or a stack of fed documents of value;

an inlet opening leading into the stacking pocket which is disposed downstream of the input opening in a document feed direction such that documents of value transported to the security container after having passed through the inlet opening fall onto the bottom element in the stacking pocket or onto a topmost document of value carried by the bottom element;

a guide section arranged to lead documents of value from the input opening to the inlet opening;

wherein, relative to the document feed direction, in or behind the inlet opening there is disposed at least partially at least one inlet opening closing element having at least one closing element portion which is deflectable from an idle closing position by fed documents of value moving through the inlet opening at a speed within a predetermined speed range, at which closing position the at least one closing element portion blocks reverse passage of a document of value that has completely entered into the stacking pocket back towards and into the inlet opening, to a deflected passing position at which the closing element guides a document of value at least partially such that at least a portion of such document of value extends into the stacking pocket; and a restoring force arrangement which acts on the closing element portion when deflected by a document of value to a passing position to exert a restoring force urging the closing element portion back towards the idle closing position, wherein the inlet opening closing element is disposed and configured such that the restoring force arrangement is provided at least partially by the force of gravity acting on the closing element and/or a portion of the closing element or a body mechanically coupled with the closing element or the portion of the closing element.

14. A security container for storing documents of value in stack form, comprising:

an input opening for receiving fed documents of value;

a stacking pocket arranged to receive fed documents of value in a stacked form from the input opening;

a bottom element disposed in the stacking pocket arranged to carry a fed document of value or a stack of fed documents of value;

an inlet opening leading into the stacking pocket which is disposed downstream of the input opening in a document feed direction such that documents of value transported to the security container after having passed through the inlet opening fall onto the bottom element in the stacking pocket or onto a topmost document of value carried by the bottom element;

a guide section arranged to lead documents of value from the input opening to the inlet opening;

wherein, relative to the document feed direction, in or behind the inlet opening there is disposed at least partially at least one inlet opening closing element having at least one closing element portion which is deflectable from an idle closing position by fed documents of value moving through the inlet opening at a speed within a predetermined speed range, at which closing position the at least one closing element portion blocks reverse passage of a document of value that has completely entered into the stacking pocket back towards and into the inlet opening, to a deflected passing position at which the closing element guides a document of value at least partially such that at least a portion of such document of value extends into the stacking pocket; and a restoring force arrangement which acts on the closing element portion when deflected by a document of value to a passing position to exert a restoring force urging the closing element portion back towards the idle closing position, wherein said restoring force arrangement comprises an elastic restoring element, which with a deflection of the inlet opening closing element or of the portion of the closing element is tensioned from the closing position into the passing position and which pushes the deflected closing element or the portion in the direction of the closing position.

15. A method for stacking documents of value in a security container, comprising the steps of:

feeding at least one document of value to the security container with an input speed and transporting the document in a transport direction by a transport system;

transporting the at least one document of value by the transport system from an input opening to an inlet opening leading into a stacking pocket with a transport speed which is greater than the input speed;

passing the document of value at least partially against and beyond at least one inlet opening closing element located in or behind the inlet opening relative to the document transport direction such that at least a portion of the document of value extends into the stacking pocket;

transporting the document of value to the security container so that the document falls onto a bottom element after having passed through the inlet opening and past the at least one inlet opening closing element;

deflecting the at least one closing element by engagement with the transported document moving through the inlet opening within a predetermined transport speed range so that the closing element is deflected from an idle inlet opening closing position to a deflected document passing position;

restoring the at least one inlet opening closing element from the deflected document passing position to an inlet opening closing position after the document of value completely enters the stacking pocket to prevent the document of value from entering back towards and into the inlet opening;

carrying the fed document of value or a stack of fed documents of value by a bottom element; and arranging received documents of value in a stacked form in the stacking pocket.

* * * * *